US006071221A

United States Patent [19]

Lozano

[11] Patent Number: 6,071,221

[45] Date of Patent: Jun. 6, 2000

[54] CARDBOARD CUTTING KIT

[76] Inventor: Jorge D. Lozano, 17243 NW. 74th Ct., Miami, Fla. 33015

[21] Appl. No.: 09/213,111

[22] Filed: Dec. 17, 1998

[51] Int. Cl.[7] ..... B31B 1/14; B26B 29/00

[52] U.S. Cl. ..... 493/340; 493/354; 493/361; 493/365; 30/286; 30/317; 83/875

[58] Field of Search ..... 493/365, 354, 493/56, 361, 340; 30/30, 122, 286, 314, 317; 83/863, 875

[56] References Cited

U.S. PATENT DOCUMENTS

| | | | |
|---|---|---|---|
| 1,882,531 | 10/1932 | Ungar | 493/365 |
| 3,052,977 | 9/1962 | Wise | 30/2 |
| 3,889,367 | 6/1975 | Walker | 30/2 |
| 4,524,894 | 6/1985 | Leblond | 83/875 |
| 4,540,394 | 9/1985 | Cavagna | 493/365 |
| 5,088,197 | 2/1992 | Anderson | 30/122 |

*Primary Examiner*—Brian L. Johnson
*Assistant Examiner*—Matthew Luby

[57] ABSTRACT

A cutting device is provided including a base adapted for being fixedly positioned on a piece of material to be cut. Also included is a handle slidably mounted on the base. Next provided is a control assembly including a shaft slidably mounted on the handle. The shaft of the control assembly is adapted to be slid between a first orientation wherein the shaft extends downwardly past a bottom face of the base and a second orientation wherein the shaft resides above the bottom face of the base. Finally, a blade or a creasing attachment is included for being mounted on the shaft.

13 Claims, 2 Drawing Sheets

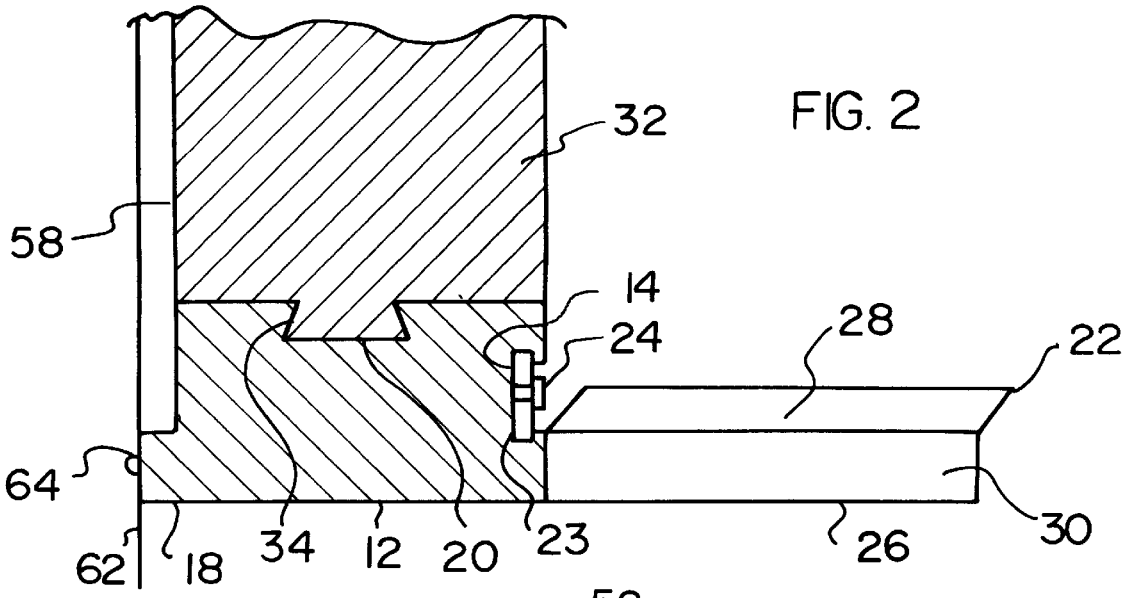
FIG. 2
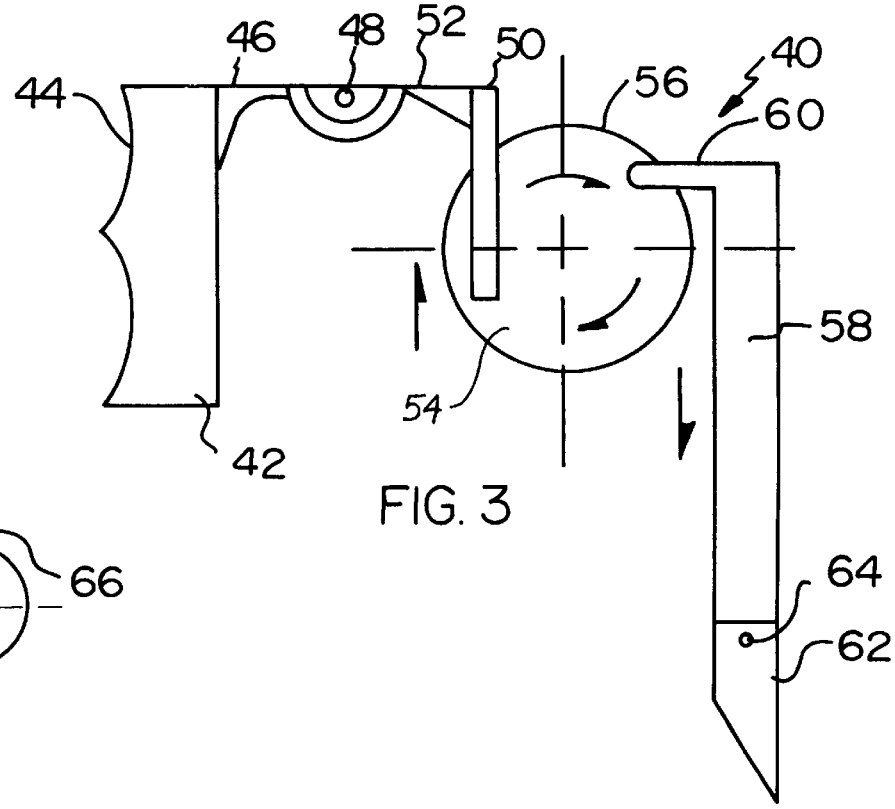
FIG. 3
FIG. 4
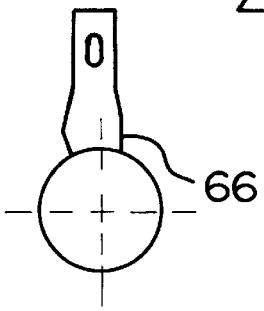

CARDBOARD CUTTING KIT

BACKGROUND OF THE INVENTION

1. Field of the Invention

The present invention relates to cutting devices and more particularly pertains to a new cardboard cutting kit for cutting and creasing pieces of cardboard and the like.

2. Description of the Prior Art

The use of cutting devices is known in the prior art. More specifically, cutting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art cutting devices include U.S. Pat. No. 4,493,148; U.S. Pat. No. 4,503,612; U.S. Pat. No. 3,889,367; U.S. Pat. No. 3,935,777; U.S. Pat. No. 3,052,977; and U.S. Pat. No. 2,442,694.

In these respects, the cardboard cutting kit according to the present invention substantially departs from the conventional concepts and designs of the prior art, and in so doing provides an apparatus primarily developed for the purpose of cutting and creasing pieces of cardboard and the like.

SUMMARY OF THE INVENTION

In view of the foregoing disadvantages inherent in the known types of cutting devices now present in the prior art, the present invention provides a new cardboard cutting kit construction wherein the same can be utilized for cutting and creasing pieces of cardboard and the like.

The general purpose of the present invention, which will be described subsequently in greater detail, is to provide a new cardboard cutting kit apparatus and method which has many of the advantages of the cutting devices mentioned heretofore and many novel features that result in a new cardboard cutting kit which is not anticipated, rendered obvious, suggested, or even implied by any of the prior art cutting devices, either alone or in any combination thereof.

To attain this, the present invention generally comprises a base with a generally rectangular configuration. The base preferably includes a top face, a bottom face, and an thin periphery formed therebetween defined by a pair of elongated side faces and a pair of short end faces. As shown in FIGS. 1 & 2, a first one of the side faces of the base has a T-shaped groove formed therein which extends between the end faces of the base. Further, the first side face has measurement indicia formed between the end faces of the base. A second one of the side edges has a lip extending therefrom along a length thereof in coplanar relationship with the bottom face of the base thus defining a ledge. The top face of the base has a dovetail recess formed therein which extends between the end faces of the base. Next provided is a pair of arms each having an inboard extent including a shape similar to a cross-section of the T-shaped groove for sliding therealong. A set screw is mounted on the inboard extent of each arm for selectively engaging the base. The set screw serves to fix the arm with respect to the base. Each of the arms further has an outboard extent fixedly connected to the inboard extent of the arm. As shown in FIG. 1, each arm extends from the first side face of the base in perpendicular relationship therewith. The outboard extent includes an upper horizontal plate maintained in coplanar relationship with the bottom face of the base. Associated therewith is a lower vertical plate integrally connected to a side edge of the upper horizontal plate and extending downwardly therefrom. Such lower vertical plate preferably resides in perpendicular relationship with the upper horizontal plate. Also included is a handle having a bottom face with a dovetail tenon formed thereon for being slidably received by the dovetail groove of the base. The handle is equipped with a pair of planar side faces in coplanar relationship with the side faces of the base. A rear face of the handle has a plurality of horizontally oriented, vertically spaced undulations formed thereon along an entire height thereof. As shown in FIG. 1, the rear face of the handle further has a lower portion with a vertical orientation and an upper portion which is beveled upwardly and inwardly from the lower portion. For reasons that will soon become apparent, a front face of the handle has an upper portion with a rectangular cut out formed therein. Further, the handle is equipped with a lower portion having an arcuate semicylindrical configuration. As best shown in FIGS. 1 and 3, a control assembly is provided including a lever having a rear face, a pair of side faces, and a front face. The front face of the control assembly is equipped with a plurality of horizontally oriented, vertically spaced grooves formed therein. Each groove has a U-shaped cross-section along a length thereof. The lever further has a protrusion formed on an upper edge of the rear face thereof. This protrusion is pivotally coupled to a pivot pin which is mounted on at least one of the side faces of the handle. Ideally, the pivot pin resides about an axis in perpendicular relationship with the side faces of the handle and further bisecting the same. The control assembly further includes an inverted L-shaped member having a short horizontally oriented upper extent fixedly coupled to an outboard end of the protrusion. Associated therewith is a vertically oriented lower extent coupled to the upper extent of the L-shaped member and extending downwardly therefrom. A disk is rotatably mounted on the second side face of the handle. The lower extent of the L-shaped member is pivotally coupled to the disk on a first side of a center thereof. Lastly, the control assembly includes a shaft having a top end with a laterally extending tab pivotally coupled to the disk on a second side of the center thereof. In use, the shaft extends downwardly from the coupling with the disk and preferably resides within a channel or the like. FIGS. 1 & 3 shown a blade attachment including an upper tab with a planar square configuration. Further, the blade attachment is equipped with an aperture formed therein for selectively coupling with a lower end of the shaft. The blade attachment further includes a lower sharpened portion with a planar generally triangular portion for cutting purposes. Yet another attachment is shown in FIG. 4. Such attachment is a creasing attachment including an upper tab with a planar square configuration, similar to that of the blade attachment. An aperture is formed in the upper tab for selectively coupling with the lower end of the shaft. In use, the creasing attachment includes a wheel rotatably mounted thereon with a roughened outer surface. In use, the lever has a first orientation such that the attachment coupled to the shaft extends downwardly past the bottom face of the base when the lever is in a first orientation. When the lever is in a second orientation, the attachment coupled to the blade shaft resides above the bottom face of the base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cardboard cutting kit apparatus and method which has many of the advantages of the cutting devices mentioned heretofore and many novel features that result in a new cardboard cutting kit which is not anticipated, rendered obvious, suggested, or even implied by any of the prior art cutting devices, either alone or in any combination thereof.

It is another object of the present invention to provide a new cardboard cutting kit which may be easily and efficiently manufactured and marketed.

It is a further object of the present invention to provide a new cardboard cutting kit which is of a durable and reliable construction.

An even further object of the present invention is to provide a new cardboard cutting kit which is susceptible of a low cost of manufacture with regard to both materials and labor, and which accordingly is then susceptible of low prices of sale to the consuming public, thereby making such cardboard cutting kit economically available to the buying public.

Still yet another object of the present invention is to provide a new cardboard cutting kit which provides in the apparatuses and methods of the prior art some of the advantages thereof, while simultaneously overcoming some of the disadvantages normally associated therewith.

Still another object of the present invention is to provide a new cardboard cutting kit for cutting and creasing pieces of cardboard and the like.

Even still another object of the present invention is to provide a new cardboard cutting kit that includes a base adapted for being fixedly positioned on a piece of material to be cut. Also included is a handle slidably mounted on the base. Next provided is a control assembly including a shaft slidably mounted on the handle. The shaft of the control assembly is adapted to be slid between a first orientation wherein the shaft extends downwardly past a bottom face of the base and a second orientation wherein the shaft resides above the bottom face of the base. Finally, a blade or a creasing attachment is included for being mounted on the shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional view of the handle and base of the present invention.

FIG. 3 is a side view of the control assembly of the present invention.

FIG. 4 is an illustration of the creasing attachment of the present invention.

DESCRIPTION OF THE PREFERRED EMBODIMENT

Figure 1:
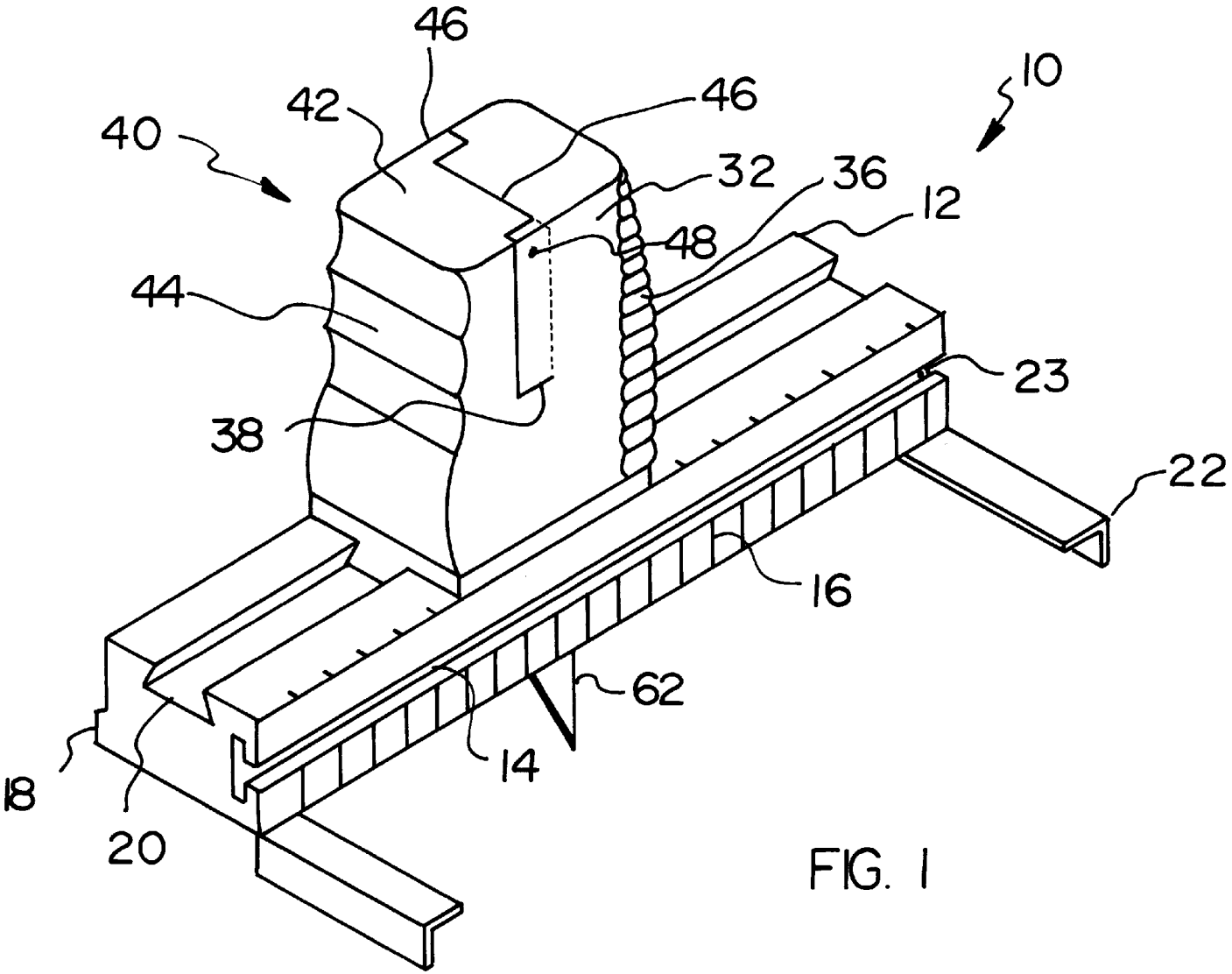
FIG. 1 is a perspective view of a new cardboard cutting kit according to the present invention.

With reference now to the drawings, and in particular to FIGS. 1 through 4 thereof, a new cardboard cutting kit embodying the principles and concepts of the present invention and generally designated by the reference numeral 10 will be described.

The present invention, designated as numeral 10, includes a base 12 with a generally rectangular configuration. The base preferably includes a top face, a bottom face, and an thin periphery formed therebetween defined by a pair of elongated side faces and a pair of short end faces. As shown in FIGS. 1 & 2, a first one of the side faces of the base has a T-shaped groove 14 formed therein which extends between the end faces of the base. Further, the first side face has measurement indicia 16 formed between the end faces of the base. A second one of the side edges has a lip 18 extending therefrom along a length thereof in coplanar relationship with the bottom face of the base thus defining a ledge. The top face of the base has a dovetail recess 20 formed therein which extends between the end faces of the base.

Next provided is a pair of arms 22 each having an inboard extent 23 including a shape similar to a cross-section of the T-shaped groove for sliding therealong. Note FIG. 2. A set screw 24 is mounted on the inboard extent of each arm for selectively engaging the base. The set screw serves to fix the arm with respect to the base. Each of the arms further has an outboard extent 26 fixedly connected to the inboard extent of the arm. As shown in FIG. 1, each arm extends from the first side face of the base in perpendicular relationship therewith. The outboard extent includes an upper horizontal plate 28 maintained in coplanar relationship with the bottom face of the base. Associated therewith is a lower vertical plate 30 integrally connected to a side edge of the upper horizontal plate and extending downwardly therefrom. Such lower vertical plate preferably resides in perpendicular relationship with the upper horizontal plate.

Also included is a handle 32 having a bottom face with a dovetail tenon 34 formed thereon for being slidably received by the dovetail groove of the base. The handle is equipped with a pair of planar side faces in coplanar relationship with the side faces of the base. A rear face of the handle has a plurality of horizontally oriented, vertically spaced undulations 36 formed thereon along an entire height thereof. Ideally, such undulations extend along a portion of the side faces of the handle. As shown in FIG. 1, the rear face of the handle further has a lower portion with a vertical orientation and an upper portion which is beveled upwardly and inwardly from the lower portion. For reasons that will soon become apparent, a front face of the handle has an upper portion with a rectangular cut out 38 formed therein. Further, the handle is equipped with a lower portion having an arcuate semicylindrical configuration.

As best shown in FIGS. 1 and 3, a control assembly 40 is provided including a lever 42 having a rear face, a pair of side faces, and a front face. The front face of the control assembly is equipped with a plurality of horizontally oriented, vertically spaced grooves 44 formed therein. Each groove has a U-shaped cross-section along a length thereof. The lever further has a protrusion 46 formed on an upper edge of the rear face thereof. This protrusion is pivotally coupled to a pivot pin 48 which is mounted on at least one of the side faces of the handle. As such, a space is formed between an interior surface of the handle and the lever. Ideally, the pivot pin resides about an axis in perpendicular relationship with the side faces of the handle and further bisecting the same.

The control assembly further includes an inverted L-shaped member 50 having a short horizontally oriented upper extent 52 fixedly coupled to an outboard end of the protrusion. Associated therewith is a vertically oriented lower extent 54 coupled to the upper extent of the L-shaped member and extending downwardly therefrom. A disk 56 is rotatably mounted on the second side face of the handle. The lower extent of the L-shaped member is pivotally coupled to the disk on a first side of a center thereof. Lastly, the control assembly includes a shaft 58 having a top end with a laterally extending tab 60 pivotally coupled to the disk on a second side of the center thereof. In use, the shaft extends downwardly from the coupling with the disk and preferably resides within an unillustrated channel or the like which limits lateral movement of the shaft. As an option, the channel may simply comprise two posts flanking the shaft or in the alternative, a cover completely housing the shaft.

It should be noted that the second side face of the handle may be easily molded with the appropriate recesses for accommodating the various components of the control assembly. Further, the L-shaped member may exhibit some degree of resiliency between the extents thereof in order to accommodate any lateral movement of the lower extent due to radial movement on the rotating wheel. Further, the aforementioned channel is wide enough to accommodate any lateral movement of the shaft due to such radial movement along the disk.

FIGS. 1 & 3 shown a blade attachment 62 including an upper tab with a planar square configuration. Further, the blade attachment is equipped with an aperture 64 formed therein for selectively coupling with a lower end of the shaft. The blade attachment further includes a lower sharpened portion with a planar generally triangular portion for cutting purposes.

Yet another attachment is shown in FIG. 4. Such attachment is a creasing attachment 66 including an upper tab with a planar square configuration, similar to that of the blade attachment. An aperture is formed in the upper tab for selectively coupling with the lower end of the shaft. In use, the creasing attachment includes a wheel rotatably mounted thereon with a roughened outer surface. It should be noted that the shaft includes a lip which lines the upper tab of the blade in order to prevent any shifting thereof.

In use, the lever has a first orientation such that the attachment coupled to the shaft extends downwardly past the bottom face of the base when the lever is in a first orientation. In such orientation, the shaft preferably abuts the ledge, as shown in FIG. 2. When the lever is in a second orientation, the attachment coupled to the blade shaft resides above the bottom face of the base. Ideally, a spring resides between an inner wall of the cut out of the handle and the rear face of the lever. This spring may be a simple coil spring or a spring wrapped about the pivot pin in order to bias the urge the lever into the second orientation thereof.

In operation, the arms of the present invention are positioned on opposite ends of a piece of cardboard such as a flap of a cardboard box. Depending on the attachment used, such piece of cardboard could then be either creased or severed by depressing the lever and sliding the handle along the base.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cardboard cutting device comprising, in combination:

a base with a generally rectangular configuration including a top face, a bottom face, and an thin periphery formed therebetween defined by a pair of elongated side faces and a pair of short end faces, a first one of the side faces of the base having a T-shaped groove formed therein and extending between the end faces of the base wherein the first side face has measurement indicia formed between the end faces thereof, a second one of the side edges having a lip extending therefrom along a length thereof in coplanar relationship with the bottom face of the base thus defining a ledge, the top face of the base having a dovetail recess formed therein and extending between the end faces of the base;

a pair of arms each having an inboard extent including a shape similar to a cross-section of the T-shaped groove for sliding therealong with a set screw mounted on the inboard extent of each arm for selectively engaging the base to fix the arm with respect to the base, each of the arms further having an outboard extent fixedly connected to the inboard extent of the arm and extending from the first side face of the base in perpendicular relationship therewith, the outboard extent including an upper horizontal plate maintained in coplanar relationship with the bottom face of the base and a lower vertical plate integrally connected to a side edge of the upper horizontal plate and extending downwardly therefrom in perpendicular relationship with the upper horizontal plate;

a handle including a bottom face with a dovetail tenon formed thereon for being slidably received by the dovetail groove of the base, a pair of planar side faces in coplanar relationship with the side faces of the base, a rear face with a plurality of horizontally oriented, vertically spaced undulations formed thereon along an entire height thereof wherein the rear face further has a lower portion with a vertical orientation and an upper portion which is beveled upwardly and inwardly from the lower portion, and a front face thereof having an upper portion with a rectangular cut out formed therein and a lower portion with an arcuate semicylindrical configuration;

a control assembly including a lever having a rear face, a pair of side faces, and a front face with a plurality of horizontally oriented, vertically spaced grooves formed therein each having a U-shaped cross-section along a length thereof, the lever having a protrusion formed on an upper edge of the rear face thereof which is pivotally coupled to a pivot pin which is mounted on at least one of the side faces of the handle about an axis in perpendicular relationship with the side faces of the handle and further bisecting the same;

said control assembly further including an inverted L-shaped member having a short horizontally oriented upper extent fixedly coupled to an outboard end of the protrusion and a vertically oriented lower extent coupled to the upper extent of the L-shaped member and extending downwardly therefrom, a disk rotatably mounted on the second side face of the handle wherein the lower extent of the L-shaped member is pivotally coupled to the disk on a first side of a center thereof, and a shaft having a top end with a laterally extending tab pivotally coupled to the disk on a second side of the center thereof, wherein the shaft extends downwardly therefrom;

a blade attachment including an upper tab with a planar square configuration and an aperture formed therein for selectively coupling with a lower end of the shaft, the blade attachment further including a lower sharpened portion with a planar generally triangular portion;

a creasing attachment including an upper tab with a planar square configuration and an aperture formed therein for selectively coupling with the lower end of the shaft, the creasing attachment further including a wheel rotatably mounted thereon;

wherein the lever has a first orientation such that the attachment coupled to the shaft extends downwardly past the bottom face of the base when the lever is in a first orientation and wherein the attachment coupled to the blade shaft resides above the bottom face of the base when the lever is in a second orientation.

2. A cutting device comprising:

a base adapted for being fixedly positioned on a piece of material to be cut;

a handle slidably mounted on the base; and a control assembly including a shaft slidably mounted on the handle and being slidable between a first orientation wherein the shaft extends downwardly past a bottom face of the base and a second orientation wherein the shaft resides above the bottom face of the base;

at least one blade being mountable on the shaft; and wherein a pair of arms are selectively mounted on the base for engaging the piece of material to be cut, wherein the arms are slidable along the base.

3. A cutting device as set forth in claim 2 wherein the handle and the base are slidably coupled by way of a tongue and groove combination.

4. A cutting device as set forth in claim 2 wherein the arms are selectively fixed with respect to the base by way of set screws.

5. A cutting device as set forth in claim 2 wherein each arm extends from a side face of the base in perpendicular relationship.

6. A cutting device as set forth in claim 2 wherein each arm forms a right angle in relationship to the base.

7. A cutting device as set forth in claim 2 wherein the control assembly includes a lever on the handle for selectively transferring the shaft between the first orientation and the second orientation.

8. A cutting device comprising:

a base adapted for being fixedly positioned on a piece of material to be cut;

a handle slidably mounted on the base; and a control assembly including a shaft slidably mounted on the handle and being slidable between a first orientation wherein the shaft extends downwardly past a bottom face of the base and a second orientation wherein the shaft resides above the bottom face of the base;

at least one creasing attachment being mountable on the shaft; and wherein a pair of arms are selectively mounted on the base for engaging the piece of material to be cut, wherein the arms are slidable along the base.

9. A cutting device as set forth in claim 8 wherein the handle and the base are slidably coupled by way of a tongue and groove combination.

10. A cutting device as set forth in claim 8 wherein the arms are selectively fixed with respect to the base by way of set screws.

11. A cutting device as set forth in claim 8 wherein each arm extends from a side face of the base in perpendicular relationship.

12. A cutting device as set forth in claim 8 wherein each arm forms a right angle in relationship to the base.

13. A cutting device as set forth in claim 8 wherein the control assembly includes a lever on the handle for selectively transferring the shaft between the first orientation and the second orientation.

* * * * *